US006330532B1

(12) United States Patent
Manjunath et al.

(10) Patent No.: US 6,330,532 B1
(45) Date of Patent: Dec. 11, 2001

(54) METHOD AND APPARATUS FOR MAINTAINING A TARGET BIT RATE IN A SPEECH CODER

(75) Inventors: Sharath Manjunath; Andrew P. Dejaco, both of San Diego, CA (US)

(73) Assignee: Qualcomm Incorporated, San Diego, CA (US)

( * ) Notice: Subject to any disclaimer, the term of this patent is extended or adjusted under 35 U.S.C. 154(b) by 0 days.

(21) Appl. No.: 09/356,493

(22) Filed: Jul. 19, 1999

(51) Int. Cl.[7] ..... G10L 21/04

(52) U.S. Cl. ..... 704/219; 704/201; 704/200; 704/270

(58) Field of Search ..... 704/219, 201, 704/220–222, 223, 224

(56) References Cited

U.S. PATENT DOCUMENTS

| | | | | |
|---|---|---|---|---|
| 4,901,307 | | 2/1990 | Gilhousen et al. | 370/18 |
| 5,103,459 | | 4/1992 | Gilhousen et al. | 375/1 |
| 5,414,796 | | 5/1995 | Jacobs et al. | 395/2.3 |
| 5,668,925 | * | 9/1997 | Rothweiler et al. | 704/220 |
| 5,727,123 | | 3/1998 | McDonough et al. | 395/2.33 |
| 5,761,636 | * | 6/1998 | Bolton et al. | 704/230 |
| 5,884,253 | | 3/1999 | Kleijn | 704/223 |
| 5,911,128 | | 6/1999 | DeJaco | 704/221 |

OTHER PUBLICATIONS

Chiang et al ("A New Rate Control Scheme using Quadratic Rate Distortion Model," International Conference on Image Processing, ©Sep. 1996).*

1978 Digital Processing of Speech Signals, "Linear Predictive Coding of Speech", L.R. Rabiner et al., pp. 411–413.

1991 Digital Signal Processing, "Methods for Waveform Interpolation in Speech Coding", W. Bastiaan Kleijn, et al., pp. 215–230.

* cited by examiner

*Primary Examiner*—Richemond Dorvil
*Assistant Examiner*—Daniel A Nolan
(74) *Attorney, Agent, or Firm*—Philip Wadsworth; Kent D. Baker; Thomas R. Rouse

(57) ABSTRACT

A method and apparatus for maintaining a target bit rate in a speech coder includes a speech coder for encoding a frame at a preselected encoding rate, computing a running average bit rate for a predefined number of encoded frames, subtracting the running average bit rate from a predefined target average bit rate, and dividing the difference by the preselected encoding rate. If the quotient value is negative, a predefined number of possible occurrence counts of speech coder performance threshold values that are less than a current performance threshold value is accumulated, the accumulated number being greater than the absolute value of the quotient. The product of a decrement-per-occurrence-count-value and the predefined number of occurrence counts is subtracted from the current performance threshold value to obtain a new performance threshold value. If the quotient value is positive, a predefined number of possible occurrence counts of speech coder performance threshold values that are greater than the current performance threshold value is accumulated, the accumulated number being greater than the quotient. The product of an increment-per-occurrence-count-value and the predefined number of occurrence counts is added to the current performance threshold value to obtain a new performance.

36 Claims, 8 Drawing Sheets

METHOD AND APPARATUS FOR MAINTAINING A TARGET BIT RATE IN A SPEECH CODER

BACKGROUND OF THE INVENTION

I. Field of the Invention

The present invention pertains generally to the field of speech processing, and more specifically to methods and apparatus for maintaining a target bit rate in speech coders.

II. Background

Transmission of voice by digital techniques has become widespread, particularly in long distance and digital radio telephone applications. This, in turn, has created interest in determining the least amount of information that can be sent over a channel while maintaining the perceived quality of the reconstructed speech. If speech is transmitted by simply sampling and digitizing, a data rate on the order of sixty-four kilobits per second (kbps) is required to achieve a speech quality of conventional analog telephone. However, through the use of speech analysis, followed by the appropriate coding, transmission, and resynthesis at the receiver, a significant reduction in the data rate can be achieved.

Devices for compressing speech find use in many fields of telecommunications. An exemplary field is wireless communications. The field of wireless communications has many applications including, e.g., cordless telephones, paging, wireless local loops, wireless telephony such as cellular and PCS telephone systems, mobile Internet Protocol (IP) telephony, and satellite communication systems. A particularly important application is wireless telephony for mobile subscribers.

Various over-the-air interfaces have been developed for wireless communication systems including, e.g., frequency division multiple access (FDMA), time division multiple access (TDMA), and code division multiple access (CDMA). In connection therewith, various domestic and international standards have been established including, e.g., Advanced Mobile Phone Service (AMPS), Global System for Mobile Communications (GSM), and Interim Standard 95 (IS-95). An exemplary wireless telephony communication system is a code division multiple access (CDMA) system. The IS-95 standard and its derivatives, IS-95A, ANSI J-STD-008, IS-95B, proposed third generation standards IS-95C and IS-2000, etc. (referred to collectively herein as IS-95), are promulgated by the Telecommunication Industry Association (TIA) and other well known standards bodies to specify the use of a CDMA over-the-air interface for cellular or PCS telephony communication systems. Exemplary wireless communication systems configured substantially in accordance with the use of the IS-95 standard are described in U.S. Pat. Nos. 5,103,459 and 4,901,307, which are assigned to the assignee of the present invention and fully incorporated herein by reference.

Devices that employ techniques to compress speech by extracting parameters that relate to a model of human speech generation are called speech coders. A speech coder divides the incoming speech signal into blocks of time, or analysis frames. Speech coders typically comprise an encoder and a decoder. The encoder analyzes the incoming speech frame to extract certain relevant parameters, and then quantizes the parameters into binary representation, i.e., to a set of bits or a binary data packet. The data packets are transmitted over the communication channel to a receiver and a decoder. The decoder processes the data packets, unquantizes them to produce the parameters, and resynthesizes the speech frames using the unquantized parameters.

The function of the speech coder is to compress the digitized speech signal into a low-bit-rate signal by removing all of the natural redundancies inherent in speech. The digital compression is achieved by representing the input speech frame with a set of parameters and employing quantization to represent the parameters with a set of bits. If the input speech frame has a number of bits $N_i$ and the data packet produced by the speech coder has a number of bits $N_o$, the compression factor achieved by the speech coder is $C_r=N_i/N_o$. The challenge is to retain high voice quality of the decoded speech while achieving the target compression factor. The performance of a speech coder depends on (1) how well the speech model, or the combination of the analysis and synthesis process described above, performs, and (2) how well the parameter quantization process is performed at the target bit rate of $N_o$ bits per frame. The goal of the speech model is thus to capture the essence of the speech signal, or the target voice quality, with a small set of parameters for each frame.

Perhaps most important in the design of a speech coder is the search for a good set of parameters (including vectors) to describe the speech signal. A good set of parameters requires a low system bandwidth for the reconstruction of a perceptually accurate speech signal. Pitch, signal power, spectral envelope (or formants), amplitude and phase spectra are examples of the speech coding parameters.

Speech coders may be implemented as time-domain coders, which attempt to capture the time-domain speech waveform by employing high time-resolution processing to encode small segments of speech (typically 5 millisecond (ms) subframes) at a time. For each subframe, a high-precision representative from a codebook space is found by means of various search algorithms known in the art. Alternatively, speech coders may be implemented as frequency-domain coders, which attempt to capture the short-term speech spectrum of the input speech frame with a set of parameters (analysis) and employ a corresponding synthesis process to recreate the speech waveform from the spectral parameters. The parameter quantizer preserves the parameters by representing them with stored representations of code vectors in accordance with known quantization techniques described in A. Gersho & R. M. Gray, *Vector Quantization and Signal Compression* (1992).

A well-known time-domain speech coder is the Code Excited Linear Predictive (CELP) coder described in L. B. Rabiner & R. W. Schafer, *Digital Processing of Speech Signals* 396–453 (1978), which is fully incorporated herein by reference. In a CELP coder, the short term correlations, or redundancies, in the speech signal are removed by a linear prediction (LP) analysis, which finds the coefficients of a short-term formant filter. Applying the short-term prediction filter to the incoming speech frame generates an LP residue signal, which is further modeled and quantized with long-term prediction filter parameters and a subsequent stochastic codebook. Thus, CELP coding divides the task of encoding the time-domain speech waveform into the separate tasks of encoding the LP short-term filter coefficients and encoding the LP residue. Time-domain coding can be performed at a fixed rate (i.e., using the same number of bits, $N_0$, for each frame) or at a variable rate (in which different bit rates are used for different types of frame contents). Variable-rate coders attempt to use only the amount of bits needed to encode the codec parameters to a level adequate to obtain a target quality. An exemplary variable rate CELP coder is described in U.S. Pat. No. 5,414,796, which is assigned to the assignee of the present invention and fully incorporated herein by reference.

Time-domain coders such as the CELP coder typically rely upon a high number of bits, $N_0$, per frame to preserve the accuracy of the time-domain speech waveform. Such coders typically deliver excellent voice quality provided the number of bits, $N_0$, per frame relatively large (e.g., 8 kbps or above). However, at low bit rates (4 kbps and below), time-domain coders fail to retain high quality and robust performance due to the limited number of available bits. At low bit rates, the limited codebook space clips the waveform-matching capability of conventional time-domain coders, which are so successfully deployed in higher-rate commercial applications. Hence, despite improvements over time, many CELP coding systems operating at low bit rates suffer from perceptually significant distortion typically characterized as noise.

There is presently a surge of research interest and strong commercial need to develop a high-quality speech coder operating at medium to low bit rates (i.e., in the range of 2.4 to 4 kbps and below). The application areas include wireless telephony, satellite communications, Internet telephony, various multimedia and voice-streaming applications, voice mail, and other voice storage systems. The driving forces are the need for high capacity and the demand for robust performance under packet loss situations. Various recent speech coding standardization efforts are another direct driving force propelling research and development of low-rate speech coding algorithms. A low-rate speech coder creates more channels, or users, per allowable application bandwidth, and a low-rate speech coder coupled with an additional layer of suitable channel coding can fit the overall bit-budget of coder specifications and deliver a robust performance under channel error conditions.

One effective technique to encode speech efficiently at low bit rates is multimode coding. An exemplary multimode coding technique is described in U.S. application Ser. No. 09/217,341, entitled VARIABLE RATE SPEECH CODING, filed Dec. 21, 1998, assigned to the assignee of the present invention, and fully incorporated herein by reference. Conventional multimode coders apply different modes, or encoding-decoding algorithms, to different types of input speech frames. Each mode, or encoding-decoding process, is customized to optimally represent a certain type of speech segment, such as, e.g., voiced speech, unvoiced speech, transition speech (e.g., between voiced and unvoiced), and background noise (nonspeech) in the most efficient manner. An external, open-loop mode decision mechanism examines the input speech frame and makes a decision regarding which mode to apply to the frame. The open-loop mode decision is typically performed by extracting a number of parameters from the input frame, evaluating the parameters as to certain temporal and spectral characteristics, and basing a mode decision upon the evaluation. The mode decision is thus made without knowing in advance the exact condition of the output speech, i.e., how close the output speech will be to the input speech in terms of voice quality or other performance measures.

Coding systems that operate at rates on the order of 2.4 kbps are generally parametric in nature. That is, such coding systems operate by transmitting parameters describing the pitch-period and the spectral envelope (or formants) of the speech signal at regular intervals. Illustrative of these so-called parametric coders is the LP vocoder system.

LP vocoders model a voiced speech signal with a single pulse per pitch period. This basic technique may be augmented to include transmission information about the spectral envelope, among other things. Although LP vocoders provide reasonable performance generally, they may introduce perceptually significant distortion, typically characterized as buzz.

In recent years, coders have emerged that are hybrids of both waveform coders and parametric coders. Illustrative of these so-called hybrid coders is the prototype-waveform interpolation (PWI) speech coding system. The PWI coding system may also be known as a prototype pitch period (PPP) speech coder. A PWI coding system provides an efficient method for coding voiced speech. The basic concept of PWI is to extract a representative pitch cycle (the prototype waveform) at fixed intervals, to transmit its description, and to reconstruct the speech signal by interpolating between the prototype waveforms. The PWI method may operate either on the LP residual signal or the speech signal. An exemplary PWI, or PPP, speech coder is described in U.S. application Ser. No. 09/217,494, entitled PERIODIC SPEECH CODING, filed Dec. 21, 1998, assigned to the assignee of the present invention, and fully incorporated herein by reference. Other PWI, or PPP, speech coders are described in U.S. Pat. No. 5,884,253 and W. Bastiaan Kleijn & Wolfgang Granzow *Methods for Waveform Interpolation in Speech Coding, in* 1 *Digital Signal Processing* 215–230 (1991).

Conventional low-bit-rate, variable-rate speech coders employ an open-loop coding mode decision based upon frame energy to determine when to switch from a lower coding rate to a higher coding rate. This permits the speech coder to exploit the presence of different classes of speech and encode them at different rates. However, encoding at the rate decided by the open-loop classification may result in poor or mediocre quality for particular frames. Accordingly, it would be advantageous to improve the efficiency of the open-loop decision. It would be desirable to use estimates of quality to change (i.e., increase if necessary) the encoding rate for a given frame. However, increasing the encoding rate for the frame will change (increase) the average coding rate for the speech coder. It would further be advantageous, therefore, to provide a speech coder that maintains a constant average bit rate while allowing deviations in encoding rates on a frame-by-frame basis from those decided by the open-loop classification. It would further be desirable to specify target average rates for the speech coder. It would further be advantageous to maintain a target overall bit rate for the speech coder. Thus, there is a need for a speech coder that refines coding mode decisions with a closed-loop decision process to give optimal voice quality, yet maintains a target coding bit rate.

SUMMARY OF THE INVENTION

The present invention is directed to a speech coder that refines coding mode decisions with a closed-loop decision process to give optimal voice quality, yet maintains a target coding bit rate. Accordingly, in one aspect of the invention, in a speech coder configured to encode a plurality of frames at varying encoding rates, a method of maintaining a target average bit rate for the speech coder advantageously includes the steps of encoding a frame at a preselected encoding rate; computing a running average bit rate for a predefined number of encoded frames; subtracting the running average bit rate from a predefined target average bit rate to obtain a difference value; dividing the difference value by the preselected encoding rate to obtain a quotient value; if the quotient value is less than zero, accumulating a first predefined number of possible occurrence counts of speech coder performance threshold values that are less than a current performance threshold value to produce a first accumulated value, the predefined number of occurrence counts of speech coder performance threshold values being chosen such that the first accumulated value is greater than the absolute value of the quotient value; if the quotient value is less than zero, subtracting the product of a decrement-per-speech-coder-performance-threshold-occurrence-count-value and the first predefined number of occurrence counts of speech coder performance threshold values from the current performance threshold value to obtain a new performance threshold value; if the quotient value is greater than or equal to zero, accumulating a second predefined number of possible occurrence counts of speech coder performance threshold values that are greater than the current performance threshold value to produce a second accumulated value, the predefined number of occurrence counts of speech coder performance threshold values being chosen such that the second accumulated value is greater than the quotient value; and if the quotient value is greater than or equal to zero, adding the product of an increment-per-speech-coder-performance-threshold-occurrence-count-value and the second predefined number of occurrences of speech coder performance threshold values to the current performance threshold value to obtain a new performance threshold value.

In another aspect of the invention, a coder advantageously includes means for encoding a frame at a preselected encoding rate; means for computing a running average bit rate for a predefined number of encoded frames; means for subtracting the running average bit rate from a predefined target average bit rate to obtain a difference value; means for dividing the difference value by the preselected encoding rate to obtain a quotient value; means for accumulating a first predefined number of possible occurrence counts of speech coder performance threshold values that are less than a current performance threshold value to produce a first accumulated value, the predefined number of occurrence counts of speech coder performance threshold values being chosen such that the first accumulated value is greater than the absolute value of the quotient value; means for subtracting the product of a decrement-per-speech-coder-performance-threshold-occurrence-count-value and the first predefined number of occurrence counts of speech coder performance threshold values from the current performance threshold value, if the quotient value is less than zero, to obtain a new performance threshold value; means for accumulating a second predefined number of possible occurrence counts of speech coder performance threshold values that are greater than the current performance threshold value to produce a second accumulated value, the predefined number of occurrence counts of speech coder performance threshold values being chosen such that the second accumulated value is greater than the quotient value; and means for adding the product of an increment-per-speech-coder-performance-threshold-occurrence-count-value and the second predefined number of occurrence counts of speech coder performance threshold values to the current performance threshold value, if the quotient value is less than zero, to obtain a new performance threshold value.

In another aspect of the invention, a speech coder advantageously includes an analysis module configured to analyze a plurality of frames; and a quantization module coupled to the analysis module and configured to encode frame parameters generated by the analysis module, wherein the quantization module is further configured to encode a frame at a preselected encoding rate; compute a running average bit rate for a predefined number of encoded frames; subtract the running average bit rate from a predefined target average bit rate to obtain a difference value; divide the difference value by the preselected encoding rate to obtain a quotient value; accumulate a first predefined number of possible occurrence counts of speech coder performance threshold values that are less than a current performance threshold value to produce a first accumulated value, the predefined number of occurrence counts of speech coder performance threshold values being chosen such that the first accumulated value is greater than the absolute value of the quotient value; subtract the product of a decrement-per-speech-coder-performance-threshold-occurrence-count-value and the first predefined number of occurrence counts of speech coder performance threshold values from the current performance threshold value, if the quotient value is less than zero, to obtain a new performance threshold value; accumulate a second predefined number of possible occurrence counts of speech coder performance threshold values that are greater than the current performance threshold value to produce a second accumulated value, the predefined number of occurrence counts of speech coder performance threshold values being chosen such that the second accumulated value is greater than the quotient value; and add the product of an increment-per-speech-coder-performance-threshold-occurrence-count-value and the second predefined number of occurrence counts of speech coder performance threshold values to the current performance threshold value, if the quotient value is less than zero, to obtain a new performance threshold value.

DETAILED DESCRIPTION OF THE PREFERRED EMBODIMENTS

The exemplary embodiments described hereinbelow reside in a wireless telephony communication system configured to employ a CDMA over-the-air interface. Nevertheless, it would be understood by those skilled in the art that a subsampling method and apparatus embodying features of the instant invention may reside in any of various communication systems employing a wide range of technologies known to those of skill in the art.

Figure 1:
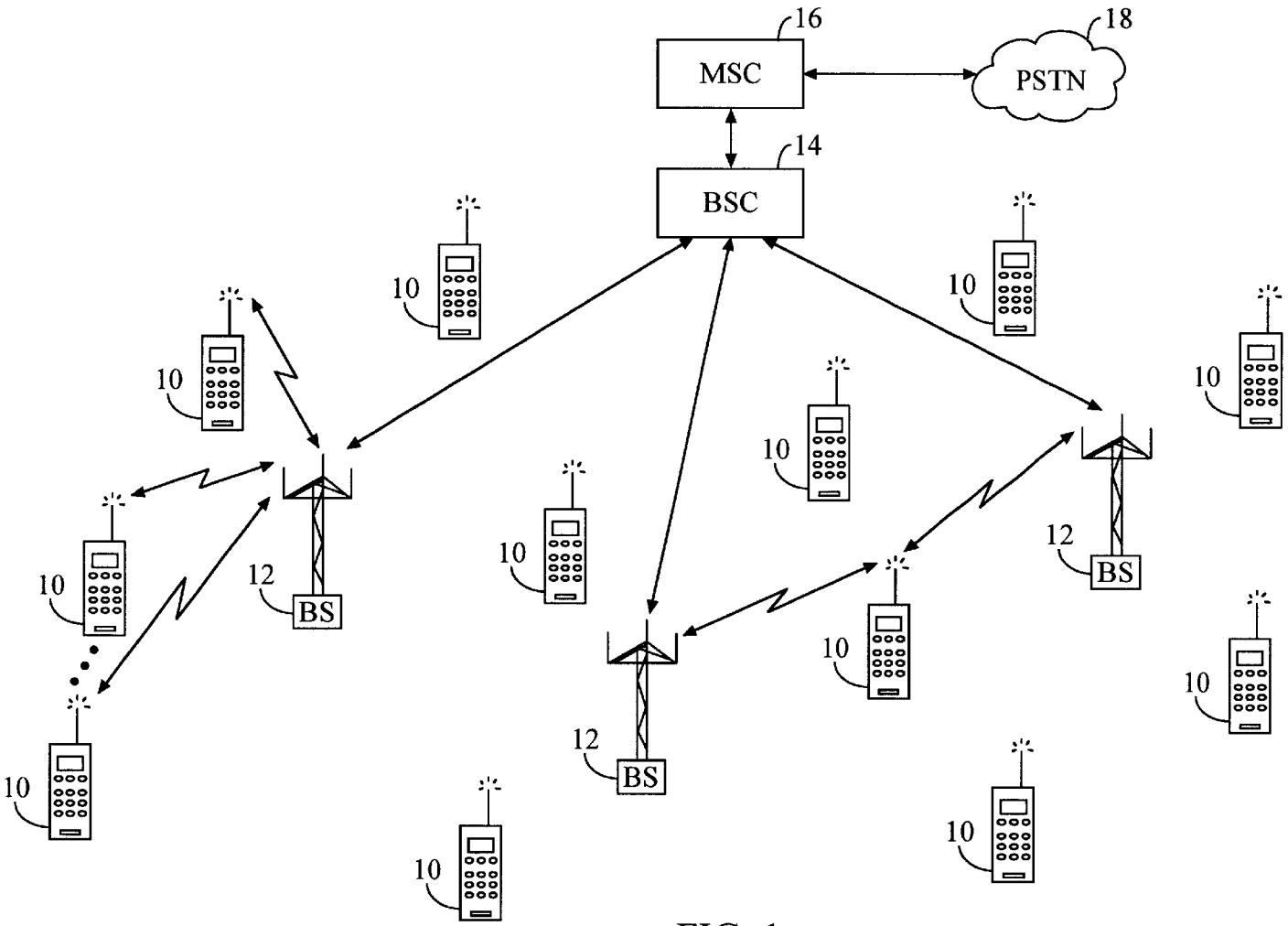
FIG. 1 PRIOR ART
FIG. 1 is a block diagram of a wireless telephone system.

As illustrated in FIG. 1, a CDMA wireless telephone system generally includes a plurality of mobile subscriber units 10, a plurality of base stations 12, base station controllers (BSCs) 14, and a mobile switching center (MSC) 16. The MSC 16 is configured to interface with a conventional public switch telephone network (PSTN) 18. The MSC 16 is also configured to interface with the BSCs 14. The BSCs 14 are coupled to the base stations 12 via backhaul lines. The backhaul lines may be configured to support any of several known interfaces including, e.g., E1/T1, ATM, IP, PPP, Frame Relay, HDSL, ADSL, or xDSL. It is understood that there may be more than two BSCs 14 in the system. Each base station 12 advantageously includes at least one sector (not shown), each sector comprising an omnidirectional antenna or an antenna pointed in a particular direction radially away from the base station 12. Alternatively, each sector may comprise two antennas for diversity reception. Each base station 12 may advantageously be designed to support a plurality of frequency assignments. The intersection of a sector and a frequency assignment may be referred to as a CDMA channel. The base stations 12 may also be known as base station transceiver subsystems (BTSs) 12. Alternatively, "base station" may be used in the industry to refer collectively to a BSC 14 and one or more BTSs 12. The BTSs 12 may also be denoted as "cell sites" 12. Alternatively, individual sectors of a given BTS 12 may be referred to as cell sites. The mobile subscriber units 10 are typically cellular or PCS telephones 10. The system is advantageously configured for use in accordance with the IS-95 standard During typical operation of the cellular telephone system, the base stations 12 receive sets of reverse link signals from sets of mobile units 10. The mobile units 10 are conducting telephone calls or other communications. Each reverse link signal received by a given base station 12 is processed within that base station 12. The resulting data is forwarded to the BSCs 14. The BSCs 14 provides call resource allocation and mobility management functionality including the orchestration of soft handoffs between base stations 12. The BSCs 14 also routes the received data to the MSC 16, which provides additional routing services for interface with the PSTN 18. Similarly, the PSTN 18 interfaces with the MSC 16, and the MSC 16 interfaces with the BSCs 14, which in turn control the base stations 12 to transmit sets of forward link signals to sets of mobile units 10.

Figure 2:
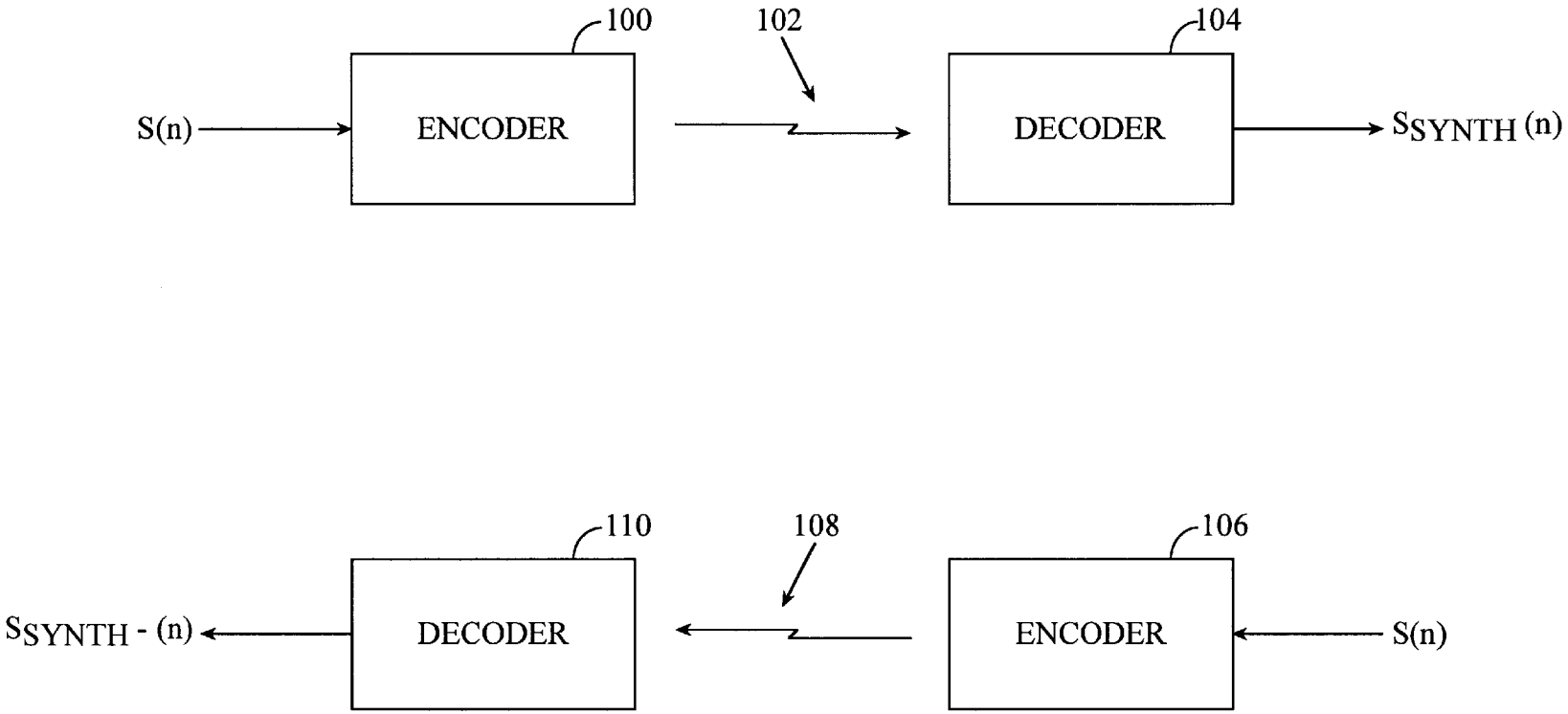
FIG. 2 PRIOR ART
FIG. 2 is a block diagram of a communication channel terminated at each end by speech coders.

In FIG. 2 a first encoder 100 receives digitized speech samples s(n) and encodes the samples s(n) for transmission on a transmission medium 102, or communication channel 102, to a first decoder 104. The decoder 104 decodes the encoded speech samples and synthesizes an output speech signal $S_{SYNTH}(n)$. For transmission in the opposite direction, a second encoder 106 encodes digitized speech samples s(n), which are transmitted on a communication channel 108. A second decoder 110 receives and decodes the encoded speech samples, generating a synthesized output speech signal $S_{SYNTH}(n)$.

The speech samples s(n) represent speech signals that have been digitized and quantized in accordance with any of various methods known in the art including, e.g., pulse code modulation (PCM), companded $\mu$-law, or A-law. As known in the art, the speech samples s(n) are organized into frames of input data wherein each frame comprises a predetermined number of digitized speech samples s(n). In an exemplary embodiment, a sampling rate of 8 kHz is employed, with each 20 ms frame comprising 160 samples. In the embodiments described below, the rate of data transmission may advantageously be varied on a frame-to-frame basis from 13.2 kbps (full rate) to 6.2 kbps (half rate) to 2.6 kbps (quarter rate) to 1 kbps (eighth rate). Varying the data transmission rate is advantageous because lower bit rates may be selectively employed for frames containing relatively less speech information. As understood by those skilled in the art, other sampling rates, frame sizes, and data transmission rates may be used.

The first encoder 100 and the second decoder 110 together comprise a first speech coder, or speech codec. The speech coder could be used in any communication device for transmitting speech signals, including, e.g., the subscriber units, BTSs, or BSCs described above with reference to FIG. 1. Similarly, the second encoder 106 and the first decoder 104 together comprise a second speech coder. It is understood by those of skill in the art that speech coders may be implemented with a digital signal processor (DSP), an application-specific integrated circuit (ASIC), discrete gate logic, firmware, or any conventional programmable software module and a microprocessor. The software module could reside in RAM memory, flash memory, registers, or any other form of writable storage medium known in the art. Alternatively, any conventional processor, controller, or state machine could be substituted for the microprocessor. Exemplary ASICs designed specifically for speech coding are described in U.S. Pat. No. 5,727,123, assigned to the assignee of the present invention and fully incorporated herein by reference, and U.S. Pat. No. 5,784,532, entitled VOCODER ASIC, issued Jul. 28, 1998, assigned to the assignee of the present invention, and fully incorporated herein by reference.

Figure 3:
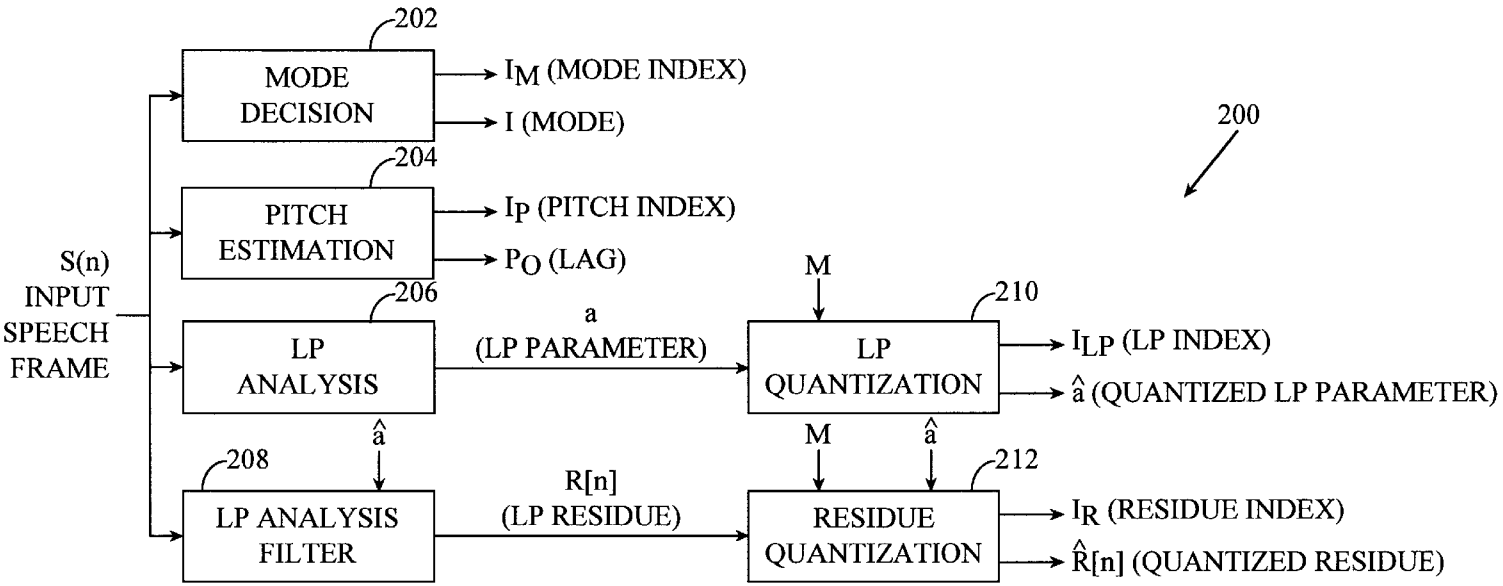
FIG. 3 PRIOR ART
FIG. 3 is a block diagram of an encoder.

In FIG. 3 an encoder 200 that may be used in a speech coder includes a mode decision module 202, a pitch estimation module 204, an LP analysis module 206, an LP analysis filter 208, an LP quantization module 210, and a residue quantization module 212. Input speech frames s(n) are provided to the mode decision module 202, the pitch estimation module 204, the LP analysis module 206, and the LP analysis filter 208. The mode decision module 202 produces a mode index $I_M$ and a mode M based upon the periodicity, energy, signal-to-noise ratio (SNR), or zero crossing rate, among other features, of each input speech frame s(n). Various methods of classifying speech frames according to periodicity are described in U.S. Pat. No. 5,911,128, which is assigned to the assignee of the present invention and fully incorporated herein by reference. Such methods are also incorporated into the Telecommunication Industry Association Industry Interim Standards TIA/EIA IS-127 and TIA/EIA IS733. An exemplary mode decision scheme is also described in the aforementioned U.S. application Ser. No. 09/217,341.

The pitch estimation module 204 produces a pitch index $I_P$ and a lag value $P_0$ based upon each input speech frame s(n). The LP analysis module 206 performs linear predictive analysis on each input speech frame s(n) to generate an LP parameter a. The LP parameter a is provided to the LP quantization module 210. The LP quantization module 210 also receives the mode M, thereby performing the quantization process in a mode-dependent manner. The LP quantization module 210 produces an LP index $I_{LP}$ and a quantized LP parameter â. The LP analysis filter 208 receives the quantized LP parameter â in addition to the input speech frame s(n). The LP analysis filter 208 generates an LP residue signal R[n], which represents the error between the input speech frames s(n) and the reconstructed speech based on the quantized linear predicted parameters â. The LP residue R[n], the mode M, and the quantized LP parameter â are provided to the residue quantization module 212. Based upon these values, the residue quantization module 212 produces a residue index $I_R$ and a quantized residue signal $\hat{R}[n]$.

Figure 4:
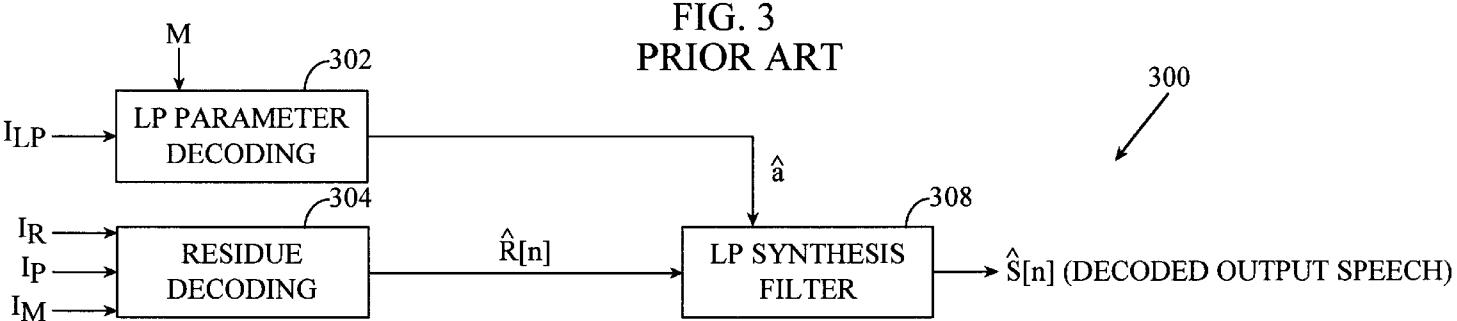
FIG. 4 PRIOR ART
FIG. 4 is a block diagram of a decoder.

In FIG. 4 a decoder 300 that may be used in a speech coder includes an LP parameter decoding module 302, a residue decoding module 304, a mode decoding module 306, and an LP synthesis filter 308. The mode decoding module 306 receives and decodes a mode index $I_M$, generating therefrom a mode M. The LP parameter decoding module 302 receives the mode M and an LP index $I_{LP}$. The LP parameter decoding module 302 decodes the received values to produce a quantized LP parameter â. The residue decoding module 304 receives a residue index $I_R$, a pitch index $I_P$, and the mode index $I_M$. The residue decoding module 304 decodes the received values to generate a quantized residue signal R̂[n]. The quantized residue signal R̂[n] and the quantized LP parameter â are provided to the LP synthesis filter 308, which synthesizes a decoded output speech signal ŝ[n] therefrom.

Operation and implementation of the various modules of the encoder 200 of FIG. 3 and the decoder 300 of FIG. 4 are known in the art and described in the aforementioned U.S. Pat. No. 5,414,796 and L. B. Rabiner & R. W. Schafer, *Digital Processing of Speech Signals* 396–453 (1978).

Figure 5:
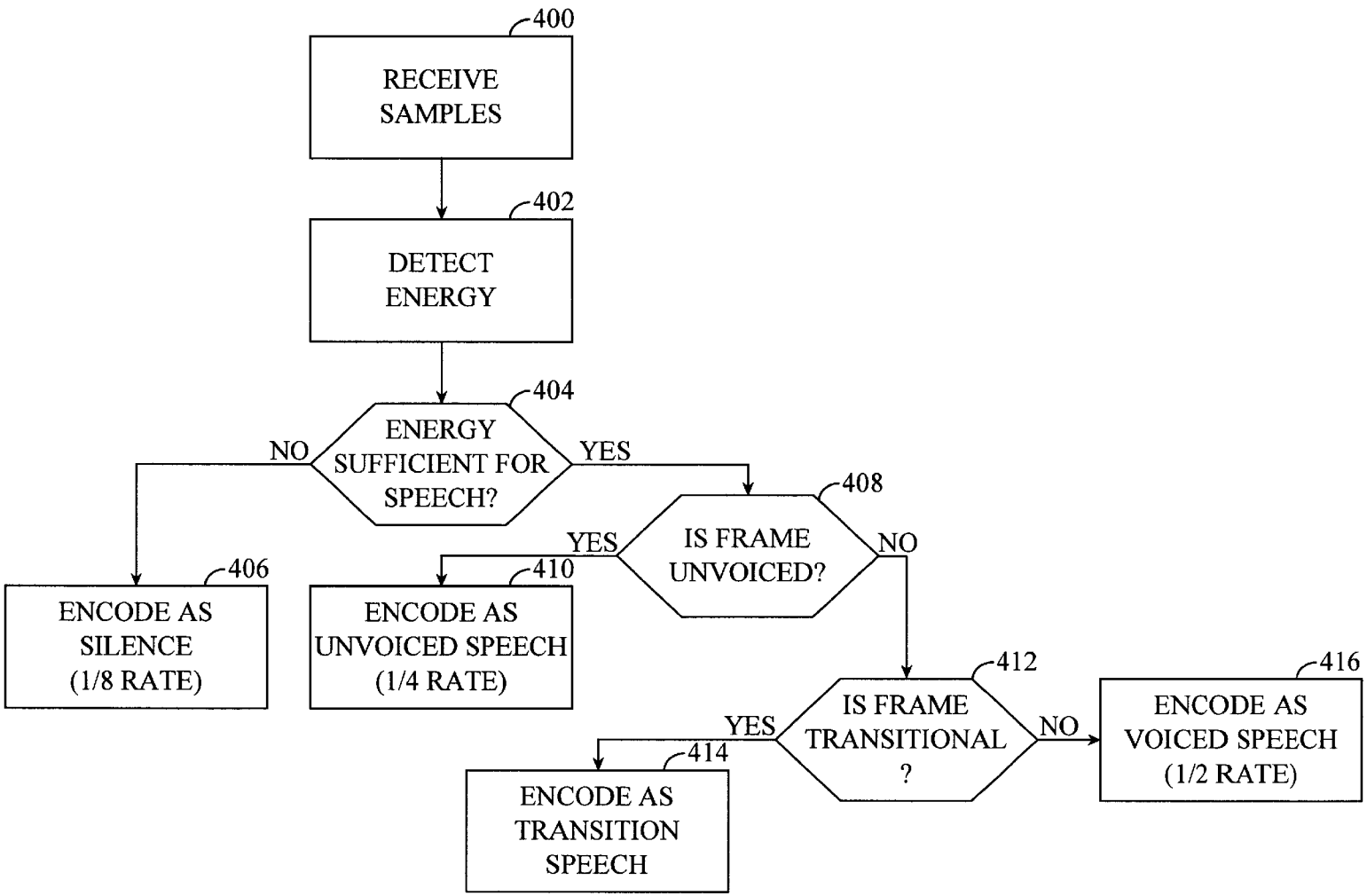
FIG. 5 PRIOR ART
FIG. 5 is a flow chart illustrating a speech coding decision process.

As illustrated in the flow chart of FIG. 5, a speech coder in accordance with one embodiment follows a set of steps in processing speech samples for transmission. In step 400 the speech coder receives digital samples of a speech signal in successive frames. Upon receiving a given frame, the speech coder proceeds to step 402. In step 402 the speech coder detects the energy of the frame. The energy is a measure of the speech activity of the frame. Speech detection is performed by summing the squares of the amplitudes of the digitized speech samples and comparing the resultant energy against a threshold value. In one embodiment the threshold value adapts based on the changing level of background noise. An exemplary variable threshold speech activity detector is described in the aforementioned U.S. Pat. No. 5,414,796. Some unvoiced speech sounds can be extremely low-energy samples that may be mistakenly encoded as background noise. To prevent this from occurring, the spectral tilt of low-energy samples may be used to distinguish the unvoiced speech from background noise, as described in the aforementioned U.S. Pat. No. 5,414,796.

After detecting the energy of the frame, the speech coder proceeds to step 404. In step 404 the speech coder determines whether the detected frame energy is sufficient to classify the frame as containing speech information. If the detected frame energy falls below a predefined threshold level, the speech coder proceeds to step 406. In step 406 the speech coder encodes the frame as background noise (i.e., nonspeech, or silence). In one embodiment the background noise frame is encoded at ⅛ rate, or 1 kbps. If in step 404 the etected frame energy meets or exceeds the predefined threshold level, the frame is classified as speech and the speech coder proceeds to step 408.

In step 408 the speech coder determines whether the frame is unvoiced speech, i.e., the speech coder examines the periodicity of the frame. Various known methods of periodicity determination include, e.g., the use of zero crossings and the use of normalized autocorrelation functions (NACFs). In particular, using zero crossings and NACFs to detect periodicity is described in the aforementioned U.S. Pat. No. 5,911,128 and U.S. application Ser. No. 09/217,341. In addition, the above methods used to distinguish voiced speech from unvoiced speech are incorporated into the Telecommunication Industry Association Interim Standards TIA/EIA IS-127 and TIA/EIA IS-733. If the frame is determined to be unvoiced speech in step 408, the speech coder proceeds to step 410. In step 410 the speech coder encodes the frame as unvoiced speech. In one embodiment unvoiced speech frames are encoded at quarter rate, or 2.6 kbps. If in step 408 the frame is not determined to be unvoiced speech, the speech coder proceeds to step 412.

In step 412 the speech coder determines whether the frame is transitional speech, using periodicity detection methods that are known in the art, as described in, e.g., the aforementioned U.S. Pat. No. 5,911,128. If the frame is determined to be transitional speech, the speech coder proceeds to step 414. In step 414 the frame is encoded as transition speech (i.e., transition from unvoiced speech to voiced speech). In one embodiment the transition speech frame is encoded in accordance with a multipulse interpolative coding method described in U.S. Pat. No. 6,260,017, entitled MULTIPULSE INTERPOLATIVE CODING OF TRANSITION SPEECH FRAMES, filed May 7, 1999, assigned to the assignee of the present invention, and fully incorporated herein by reference. In another embodiment the transition speech frame is encoded at full rate, or 13.2 kbps.

If in step 412 the speech coder determines that the frame is not transitional speech, the speech coder proceeds to step 416. In step 416 the speech coder encodes the frame as voiced speech. In one embodiment voiced speech frames may be encoded at half rate, or 6.2 kbps. It is also possible to encode voiced speech frames at full rate, or 13.2 kbps (or full rate, 8 kbps, in an 8 k CELP coder). Those skilled in the art would appreciate, however, that coding voiced frames at half rate allows the coder to save valuable bandwidth by exploiting the steady-state nature of voiced frames. Further, regardless of the rate used to encode the voiced speech, the voiced speech is advantageously coded using information from past frames, and is hence said to be coded predictively.

Figure 6A:
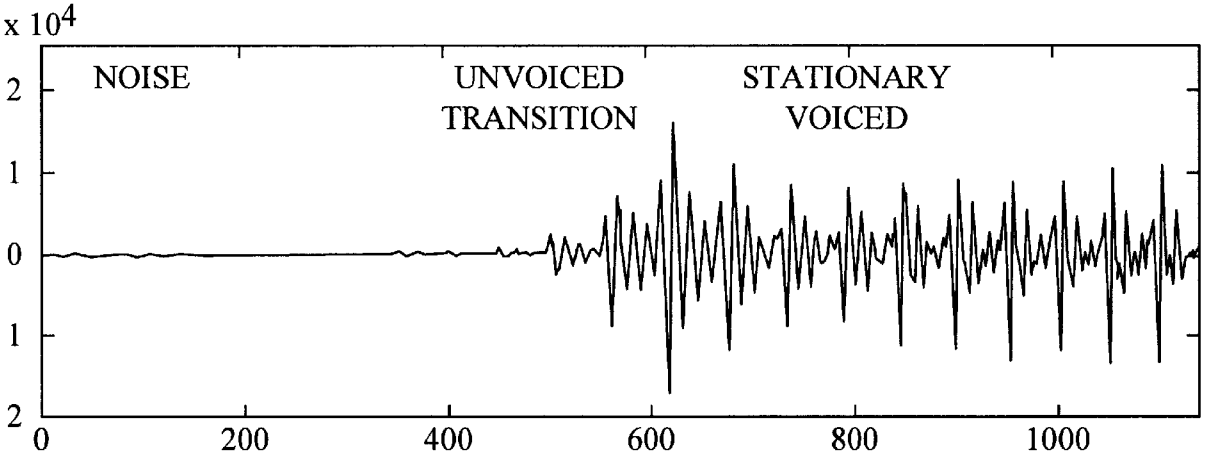
FIG. 6A PRIOR ART
FIG. 6A is a graph speech signal amplitude versus time.
Figure 6B:
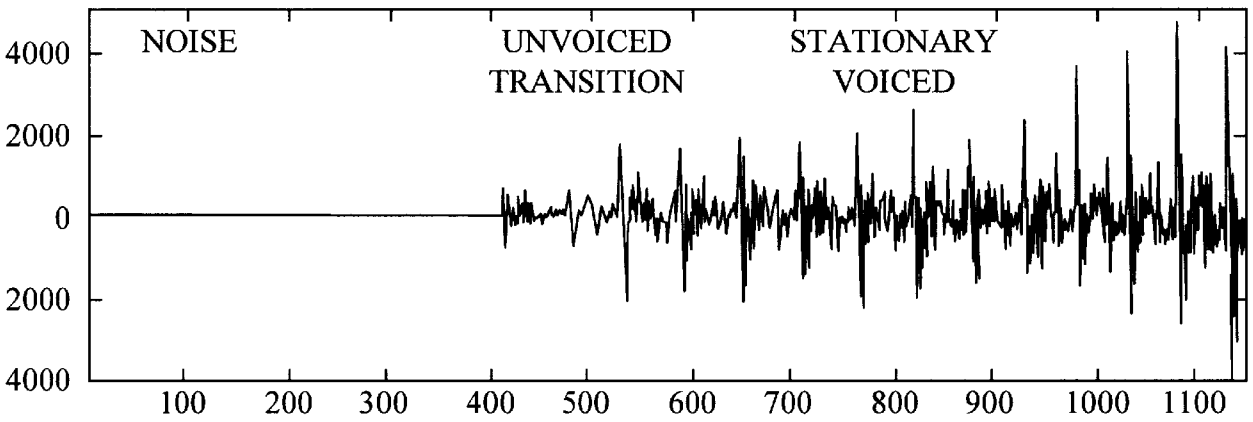
FIG. 6B PRIOR ART
FIG. 6B is a graph of linear prediction (LP) residue amplitude versus time.

Those of skill would appreciate that either the speech signal or the corresponding LP residue may be encoded by following the steps shown in FIG. 5. The waveform characteristics of noise, unvoiced, transition, and voiced speech can be seen as a function of time in the graph of FIG. 6A. The waveform characteristics of noise, unvoiced, transition, and voiced LP residue can be seen as a function of time in the graph of FIG. 6B.

Figure 7:
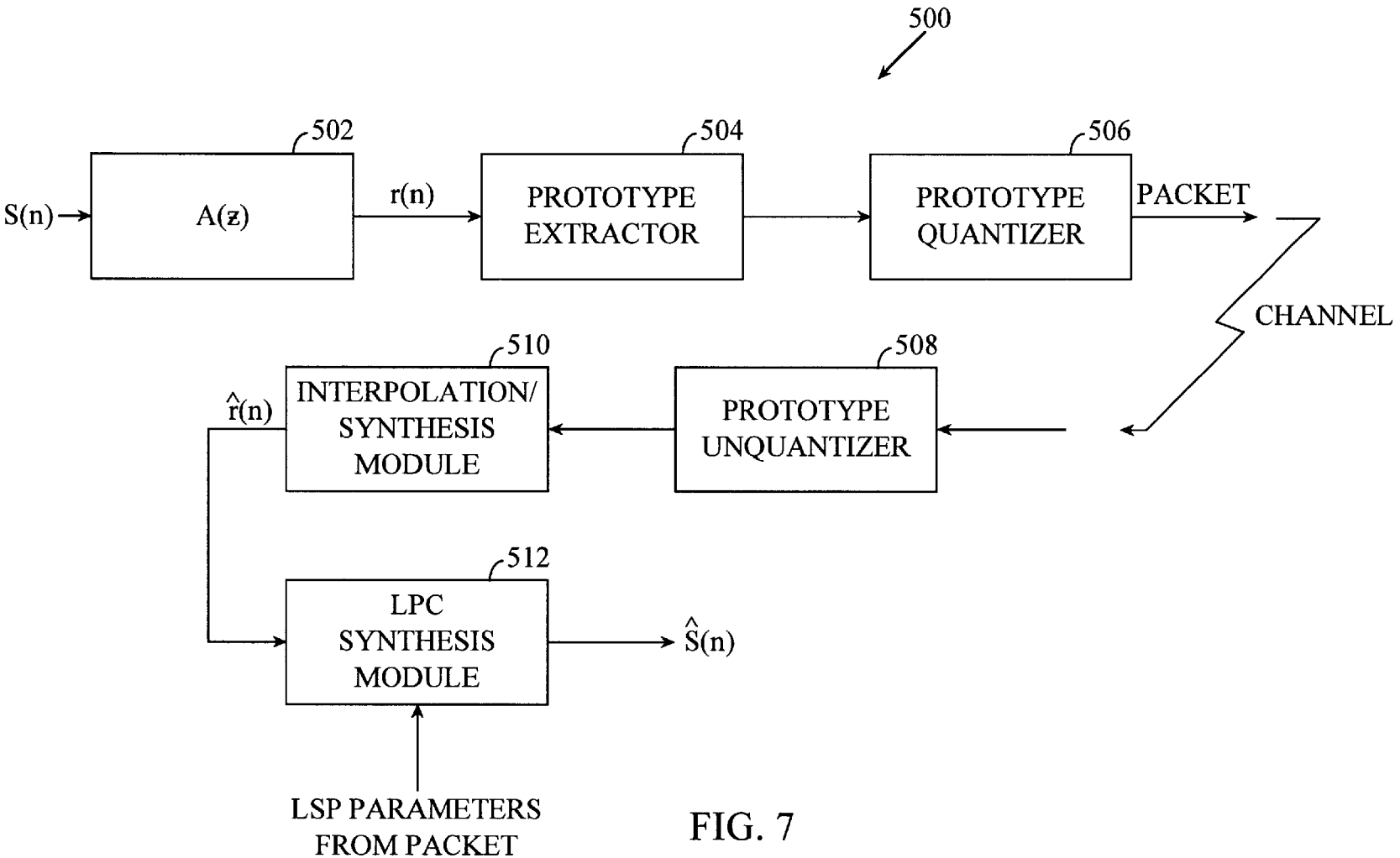
FIG. 7 is a block diagram of a prototype pitch period (PPP) speech coder.

In one embodiment a prototype pitch period (PPP) speech coder 500 includes an inverse filter 502, a prototype extractor 504, a prototype quantizer 506, a prototype unquantizer 508, an interpolation/synthesis module 510, and an LPC synthesis module 512, as illustrated in FIG. 7. The speech coder 500 may advantageously be implemented as part of a DSP, and may reside in, e.g., a subscriber unit or base station in a PCS or cellular telephone system, or in a subscriber unit or gateway in a satellite system.

In the speech coder 500, a digitized speech signal s(n), where n is the frame number, is provided to the inverse LP filter 502. In a particular embodiment, the frame length is twenty ms. The transfer function of the inverse filter A(z) is computed in accordance with the following equation:

$$A(z)=1-a_1z^{-1}-a_2z^{-2}- \ldots -a_pz^{-p},$$

where the coefficients $a_I$ are filter taps having predefined values chosen in accordance with known methods, as described in the aforementioned U.S. Pat. No. 5,414,796 and U.S. application Ser. No. 09/217,494, both previously fully incorporated herein by reference. The number p indicates the number of previous samples the inverse LP filter 502 uses for prediction purposes. In a particular embodiment, p is set to ten.

The inverse filter 502 provides an LP residual signal r(n) to the prototype extractor 504. The prototype extractor 504 extracts a prototype from the current frame. The prototpye is a portion of the current frame that will be linearly interpolated by the interpolation/synthesis module 510 with prototypes from previous frames that were similarly positioned within the frame in order to reconstruct the LP residual signal at the decoder.

The prototype extractor 504 provides the prototype to the prototype quantizer 506, which may quantize the prototype in accordance with any of various quantization techniques that are known in the art. The quantized values, which may be obtained from a lookup table (not shown), are assembled into a packet, which includes lag and other codebook parameters, for transmission over the channel. The packet is provided to a transmitter (not shown) and transmitted over the channel to a receiver (also not shown). The inverse LP filter 502, the prototype extractor 504, and the prototype quantizer 506 are said to have performed PPP analysis on the current frame.

The receiver receives the packet and provides the packet to the prototype unquantizer 508. The prototype unquantizer 508 may unquantize the packet in accordance with any of various known techniques. The prototype unquantizer 508 provides the unquantized prototype to the interpolation/synthesis module 510. The interpolation/synthesis module 510 interpolates the prototype with prototypes from previous frames that were similarly positioned within the frame in order to reconstruct the LP residual signal for the current frame. The interpolation and frame synthesis is advantageously accomplished in accordance with known methods described in U.S. Pat. No. 5,884,253 and in the aforementioned U.S. application Ser. No. 09/217,494.

The interpolation/synthesis module 510 provides the reconstructed LP residual signal $\hat{r}(n)$ to the LPC synthesis module 512. The LPC synthesis module 512 also receives line spectral pair (LSP) values from the transmitted packet, which are used to perform LPC filtration on the reconstructed LP residual signal $\hat{r}(n)$ to create the reconstructed speech signal $\hat{s}(n)$ for the current frame. In an alternate embodiment, LPC synthesis of the speech signal $\hat{s}(n)$ may be performed for the prototype prior to doing interpolation/synthesis of the current frame. The prototype unquantizer 508, the interpolation/synthesis module 510, and the LPC synthesis module 512 are said to have performed PPP synthesis of the current frame.

In one embodiment a speech coder, such as the PPP speech coder 500 of FIG. 7, applies a closed-loop coding performance measure to each encoded frame while maintaining a target average bit rate for the speech coder. The speech coder may be a PPP speech coder or any other type of low-bit-rate speech coder that could improve voice quality by increasing the coding rate on a per-frame basis.

After open-loop classification of a speech frame (a frame, in one embodiment, comprises a twenty-ms segment of speech), the speech frame is encoded using a preselected rate Rp. A closed-loop performance test is then performed. An encoder performance measure is obtained after full or partial encoding using the preselected rate Rp. Exemplary performance measures that are well known in the relevant art include, e.g., signal-to-noise ratio (SNR), SNR prediction in encoding schemes such as the PPP speech coder, prediction error quantization SNR, phase quantization SNR, amplitude quantization SNR, perceptual SNR, and normalized cross-correlation between current and past frames as a measure of stationarity). If the performance measure, PNM, falls below a threshold value, PNM_TH, the encoding rate is changed to a value for which the encoding scheme is expected to give better quality. Typically, this means that the coding rate change is an increase. An exemplary closed-loop classification scheme to maintain the quality of a variable-rate speech coder is described in U.S. application Ser. No. 09/191,643, entitled CLOSED-LOOP VARIABLE-RATE MULTI-MODE PREDICTIVE SPEECH CODER, filed Nov. 13, 1998, assigned to the assignee of the present invention, and fully incorporated herein by reference.

The performance measure, PNM, is also advantageously used to update a histogram of thresholds around the current value of the threshold, PNM_TH. The histogram is used to effect an overall control of the average bit rate for the speech coder in the following manner. The speech coder computes the running average bit rate over a window of W frames, resets the running average bit rate to zero after W frames, and recomputes the running average bit rate for the next W frames. At the end of a W-frame period, the average bit rate is subtracted from the target average bit rate, AVR, and the difference is divided by the original, preselected encoding rate value Rp.

If the quotient, NR, of the division AVR/Rp is positive, the histogram values for the first BR bins, or histogram bar widths, to the right of PNM_TH (i.e., the first BR bins associated with a higher coding rate than the threshold) are accumulated. The value of BR is advantageously chosen such that the accumulated value is greater than NR. The threshold PNM_TH is then increased by an amount that is equal to the product DTH_HI*BR, where DTH_HI is the amount of increment per bin. It should be noted that DTH_HI is first initialized to a suitable value. One such suitable value is (MAX_TH PNM−PNM_TH)/HB (the parameters are defined hereinbelow).

If the quotient NR is negative, the histogram values for the first BL bins to the left of PNM_TH are accumulated. The value of BL is advantageously chosen such that the accumulated value is greater than −NR. The threshold PNM_TH is then decreased by an amount that is equal to the product DTH_LO*BL, where DTH_LO is the amount of decrement per bin. It should be noted that DTH_LO is first initialized to a suitable value. One such suitable value is (PNM_TH−MIN_TH)/HB (the parameters are defined hereinbelow).

The performance threshold PNM_TH could be limited to maximum and minimum values MAX_TH and MIN_TH, respectively, if such maximum and minimum values or estimates thereof are known. Advantageously, the decrement per bin DTH_LO and the increment per bin DTH_HI may, if desired, be updated to the quotient amounts (PNM_TH−MIN_TH)/HB and (MAX_TH−PNM_TH)/HB, respectively, where HB is equal to half of the number of bins in the histogram. When the speech coder has finished keeping the average bit rate close to the target average bit rate, AVR, for the W-frame window, the histogram values for all of the 2HB bins of the histogram are advantageously reset to zero.

In one embodiment the update of the histogram values takes place during the encoding using the preselected rate Rp. This is accomplished in the following manner. First, the bins are updated. Each of the HB bins to the left of the threshold PNM_TH is set equal to the value of the difference PNM_TH−DTH_LO*i for the ith bin to the left of the threshold PNM_TH (the threshold PNM_TH is located at the center of the histogram). Each of the HB bins to the right of the threshold PNM_TH is set equal to the value of the sum PNM_TH+DTH_HI*i for the ith bin to the right of the threshold PNM_TH. Second, the histogram value of the bin that contains PNM, the current performance measure value, is incremented by one.

Figure 8:
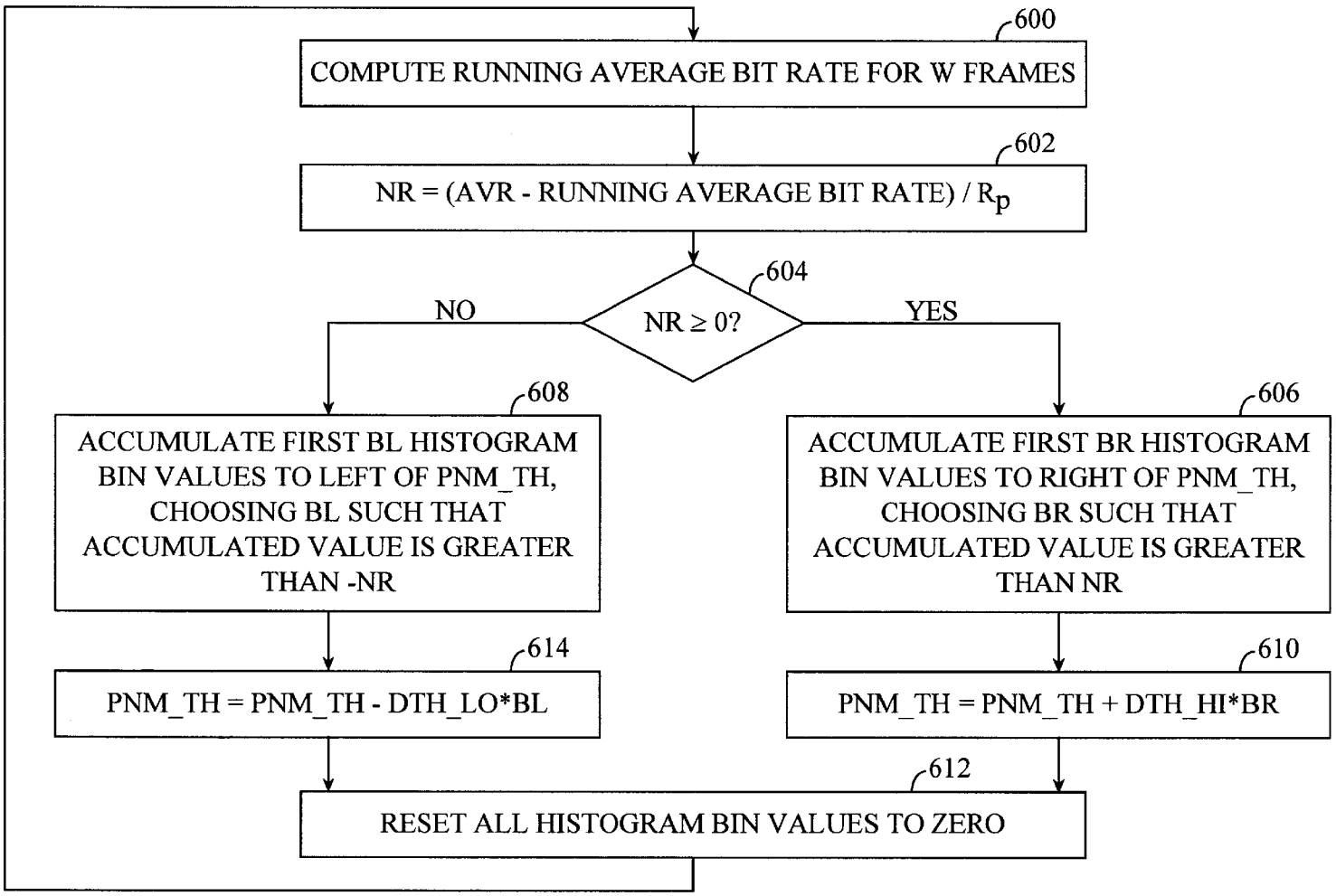
FIG. 8 is a flow chart illustrating algorithm steps performed by a speech coder, such as the speech coder of FIG. 7, to apply a closed-loop coding performance measure to each encoded frame while maintaining a target average bit rate for the speech coder.

In one embodiment a speech coder, such as the PPP speech coder 500 of FIG. 7, performs the algorithm steps illustrated by the flow chart of FIG. 8 to apply a closed-loop coding performance measure, PNM, to each encoded frame while maintaining a target average bit rate for the speech coder. The speech coder may be a PPP speech coder or any other type of low-bit-rate speech coder that could improve voice quality by increasing the coding rate on a per-frame basis.

The current speech frame is encoded at a rate Rp based upon open-loop classification of the contents of the frame. A closed-loop test is then applied to the frame such that if a speech coding performance measure, PNM, falls below a performance threshold value, PNM_TH, the encoding rate is increased. The threshold PNM_TH is then adjusted in accordance with the following method steps to keep the running average bit rate of the speech coder at, or close to, a target average bit rate, AVR.

In step 600 the speech coder computes the running average bit rate for a window of W frames in length. The speech coder then proceeds to step 602. In step 602 the speech coder computes the quotient NR=(AVR−running average bit rate)/Rp. The speech coder then proceeds to step 604. In step 604 the speech coder determines whether NR is greater than or equal to zero. If NR is greater than or equal to zero, the speech coder proceeds to step 606. If, on the other hand, NR is not greater than or equal to zero, the speech coder proceeds to step 608.

In step 606 the speech coder accumulates the first BR histogram bin values to the right of PNM_TH (which is at the center of the histogram), choosing BR such that the accumulated value is greater than NR. The speech coder then proceeds to step 610. In step 610 the speech coder sets PNM_TH equal to the sum of PNM_TH and DTH_HI*BR, where DTH_HI is equal to the amount of increment per histogram bin. The speech coder then proceeds to step 612.

In step 608 the speech coder accumulates the first BL histogram bin values to the left of PNM_TH, choosing BL such that the accumulated value is greater than −NR. The speech coder then proceeds to step 614. In step 614 the speech coder sets PNM_TH equal to the difference between PNM_TH and DTH_LO*BR, where DTH_LO is equal to the amount of decrement per histogram bin. The speech coder then proceeds to step 612.

The steps of constraining PNM_TH to maximum and minimum values, MAX_TH and MIN_TH, respectively, may, if desired, be performed before step 612. Additionally, the steps of updating the decrement per bin DTH_LO and the increment per bin DTH_HI to the quotient amounts (PNM_TH−MIN_TH)/HB and (MAX_TH−PNM_TH)/HB, respectively, where HB is equal to half of the number of bins in the histogram, may, if desired, be performed before step 612. It should be noted also that DTH_HI and DTH_LO should first be initialized to suitable values such as (MAX_TH−PNM_TH)/HB and( PNM_TH−MIN_TH)/HB, respectively.

In step 612 the speech coder resets the histogram values for all of the 2HB histogram bins to zero. The speech coder then returns to step 600 to compute the running average bit rate for the next W frames.

Figure 9:
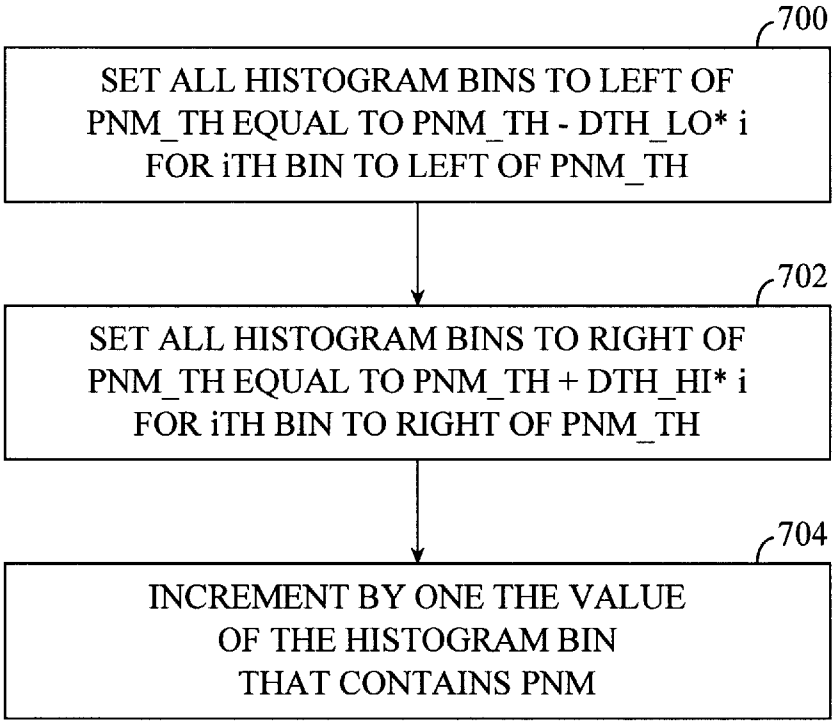
FIG. 9 is a flow chart illustrating algorithm steps performed by a speech coder to update the values of histogram bins during encoding of a speech frame.

In one embodiment the speech coder performs the algorithm steps illustrated in the flow chart of FIG. 9 to update the values of the histogram bins during encoding of the speech frame at the encoding rate Rp, for each of the W frames. In step 700 the speech coder sets all histogram bins to the left of PNM_TH equal to the value of the difference PNM_TH−DTH_LO*i for the ith bin to the left of the threshold PNM_TH. The speech coder then proceeds to step 702. In step 702 the speech coder sets all histogram bins to the right of PNM_TH equal to the value of the sum PNM_TH+DTH_HI*i for the ith bin to the right of the threshold PNM_TH. The speech coder then proceeds to step 704. In step 704 the speech coder the increments by one the value of the histogram bin that contains PNM, the current performance measure value.

Thus, a novel method and apparatus for maintaining a target bit rate in a speech coder has been described. Those of skill in the art would understand that the various illustrative logical blocks and algorithm steps described in connection with the embodiments disclosed herein may be implemented or performed with a digital signal processor (DSP), an application specific integrated circuit (ASIC), discrete gate or transistor logic, discrete hardware components such as, e.g., registers and FIFO, a processor executing a set of firmware instructions, or any conventional programmable software module and a processor. The processor may advantageously be a microprocessor, but in the alternative, the processor may be any conventional processor, controller, microcontroller, or state machine. The software module could reside in RAM memory, flash memory, registers, or any other form of writable storage medium known in the art. Those of skill would further appreciate that the data, instructions, commands, information, signals, bits, symbols, and chips that may be referenced throughout the above description are advantageously represented by voltages, currents, electromagnetic waves, magnetic fields or particles, optical fields or particles, or any combination thereof.

Preferred embodiments of the present invention have thus been shown and described. It would be apparent to one of ordinary skill in the art, however, that numerous alterations may be made to the embodiments herein disclosed without departing from the spirit or scope of the invention. Therefore, the present invention is not to be limited except in accordance with the following claims.

What is claimed is:

1. In a speech coder configured to encode a plurality of frames at varying encoding rates, a method of maintaining a target average bit rate for the speech coder, comprising the steps of:

encoding a frame at a preselected encoding rate;

computing a running average bit rate for a predefined number of encoded frames;

subtracting the running average bit rate from a predefined target average bit rate to obtain a difference value;

dividing the difference value by the preselected encoding rate to obtain a quotient value;

if the quotient value is less than zero, accumulating a first predefined number of possible occurrence counts of speech coder performance threshold values that are less than a current performance threshold value to produce a first accumulated value, the predefined number of occurrence counts of speech coder performance threshold values being chosen such that the first accumulated value is greater than the absolute value of the quotient value;

if the quotient value is less than zero, subtracting the product of a decrement-per-speech-coder-performance-threshold-occurrence-count-value and the first predefined number of occurrence counts of speech coder performance threshold values from the current performance threshold value to obtain a new performance threshold value;

if the quotient value is greater than or equal to zero, accumulating a second predefined number of possible occurrence counts of speech coder performance threshold values that are greater than the current performance threshold value to produce a second accumulated value, the predefined number of occurrence counts of speech coder performance threshold values being chosen such that the second accumulated value is greater than the quotient value; and if the quotient value is greater than or equal to zero, adding the product of an increment-per-speech-coder-performance-threshold-occurrence-count-value and the second predefined number of occurrences of speech coder performance threshold values to the current performance threshold value to obtain a new performance threshold value.

2. The method of claim 1, further comprising the steps of comparing speech coder performance with a predefined performance measure and adjusting the preselected encoding rate for the frame if the speech coder performance for the frame falls below the current performance threshold value.

3. The method of claim 2, wherein the adjusting step comprises increasing the encoding rate for the frame.

4. The method of claim 2, further comprising the steps of, during the encoding step:

for each occurrence count of a speech coder performance threshold value that is less than the current performance threshold value, subtracting the product of the decrement-per-speech-coder-performance-threshold-occurrence-count-value and one plus the number of occurrence counts of speech coder performance threshold values between the occurrence count of a speech coder performance threshold value and the current performance threshold value from the current performance threshold value, and setting the occurrence count of a speech coder performance threshold value equal to the result of the subtraction;

for each occurrence count of a speech coder performance threshold value that is greater than the current performance threshold value, adding the product of the increment-per-speech-coder-performance-threshold-occurrence-count-value and one plus the number of occurrence counts of speech coder performance threshold values between the occurrence count of a speech coder performance threshold value and the current performance threshold value to the current performance threshold value, and setting the occurrence count of a speech coder performance threshold value equal to the result of the addition; and incrementing by one the occurrence count of a speech coder performance threshold value that corresponds to the current speech coder performance.

5. The method of claim 1, further comprising the step of obtaining the preselected encoding rate from an open-loop classification of the frame.

6. The method of claim 1, further comprising the step of constraining the current performance threshold to a maximum value.

7. The method of claim 1, further comprising the step of constraining the current performance threshold to a minimum value.

8. The method of claim 1, further comprising the step of assigning initial values to the decrement-per-speech-coder-performance-threshold-occurrence-count-value and the increment-per-speech-coder-performance-threshold-occurrence-count-value.

9. The method of claim 1, further comprising the step of resetting all occurrence counts of speech coder performance threshold values to zero after performing either the adding step or the subtracting step.

10. The method of claim 1, wherein the frame is a speech frame.

11. The method of claim 1, wherein the frame is a linear predictive residue frame.

12. The method of claim 1, wherein the speech coder resides in a subscriber unit of a wireless communication system.

13. A speech coder, comprising:

means for encoding a frame at a preselected encoding rate;

means for computing a running average bit rate for a predefined number of encoded frames;

means for subtracting the running average bit rate from a predefined target average bit rate to obtain a difference value;

means for dividing the difference value by the preselected encoding rate to obtain a quotient value;

means for accumulating a first predefined number of possible occurrence counts of speech coder performance threshold values that are less than a current performance threshold value to produce a first accumulated value, the predefined number of occurrence counts of speech coder performance threshold values being chosen such that the first accumulated value is greater than the absolute value of the quotient value;

means for subtracting the product of a decrement-per-speech-coder-performance-threshold-occurrence-count-value and the first predefined number of occurrence counts of speech coder performance threshold values from the current performance threshold value, if the quotient value is less than zero, to obtain a new performance threshold value;

means for accumulating a second predefined number of possible occurrence counts of speech coder performance threshold values that are greater than the current performance threshold value to produce a second accumulated value, the predefined number of occurrence counts of speech coder performance threshold values being chosen such that the second accumulated value is greater than the quotient value; and means for adding the product of an increment-per-speech-coder-performance-threshold-occurrence-count-value and the second predefined number of occurrence counts of speech coder performance threshold values to the current performance threshold value, if the quotient value is less than zero, to obtain a new performance threshold value.

14. The speech coder of claim 13, further comprising means for comparing speech coder performance with a predefined performance measure and means for adjusting the preselected encoding rate for the frame if the speech coder performance for the frame falls below the current performance threshold value.

15. The speech coder of claim 14, wherein the means for adjusting comprises means for increasing the encoding rate for the frame.

16. The speech coder of claim 14, further comprising:

means for subtracting, during encoding of the frame, for each occurrence count of a speech coder performance threshold value that is less than the current performance threshold value, the product of the decrement-per-speech-coder-performance-threshold-occurrence-count-value and one plus the number of occurrence counts of speech coder performance threshold values between the occurrence count of a speech coder performance threshold value and the current performance threshold value from the current performance threshold value, and setting the occurrence count of a speech coder performance threshold value equal to the result of the subtraction;

means for adding, during encoding of the frame, for each occurrence count of a speech coder performance threshold value that is greater than the current performance threshold value, the product of the increment-per-speech-coder-performance-threshold-occurrence-count-value and one plus the number of occurrence counts of speech coder performance threshold values between the occurrence count of a speech coder performance threshold value and the current performance threshold value to the current performance threshold value, and setting the occurrence count of a speech coder performance threshold value equal to the result of the addition; and means for incrementing by one, during encoding of the frame, the occurrence count of a speech coder performance threshold value that corresponds to the current speech coder performance.

17. The speech coder of claim 13, further comprising means for obtaining the preselected encoding rate from an open-loop classification of the frame.

18. The speech coder of claim 13, further comprising means for constraining the current performance threshold to a maximum value.

19. The speech coder of claim 13, further comprising means for constraining the current performance threshold to a minimum value.

20. The speech coder of claim 13, further comprising means for assigning initial values to the decrement-per-speech-coder-performance-threshold-occurrence-count-value and the increment-per-speech-coder-performance-threshold-occurrence-count-value.

21. The speech coder of claim 13, further comprising means for resetting all occurrence counts of speech coder performance threshold values to zero after the current performance threshold value has been adjusted.

22. The speech coder of claim 13, wherein the frame is a speech frame.

23. The speech coder of claim 13, wherein the frame is a linear predictive residue frame.

24. The speech coder of claim 13, wherein the speech coder resides in a subscriber unit of a wireless communication system.

25. A speech coder, comprising:

an analysis module configured to analyze a plurality of frames; and a quantization module coupled to the analysis module and configured to encode frame parameters generated by the analysis module, wherein the quantization module is further configured to:

encode a frame at a preselected encoding rate;

compute a running average bit rate for a predefined number of encoded frames;

subtract the running average bit rate from a predefined target average bit rate to obtain a difference value;

divide the difference value by the preselected encoding rate to obtain a quotient value;

accumulate a first predefined number of possible occurrence counts of speech coder performance threshold values that are less than a current performance threshold value to produce a first accumulated value, the predefined number of occurrence counts of speech coder performance threshold values being chosen such that the first accumulated value is greater than the absolute value of the quotient value;

subtract the product of a decrement-per-speech-coder-performance-threshold-occurrence-count-value and the first predefined number of occurrence counts of speech coder performance threshold values from the current performance threshold value, if the quotient value is less than zero, to obtain a new performance threshold value;

accumulate a second predefined number of possible occurrence counts of speech coder performance threshold values that are greater than the current performance threshold value to produce a second accumulated value, the predefined number of occurrence counts of speech coder performance threshold values being chosen such that the second accumulated value is greater than the quotient value; and add the product of an increment-per-speech-coder-performance-threshold-occurrence-count-value and the second predefined number of occurrence counts of speech coder performance threshold values to the current performance threshold value, if the quotient value is less than zero, to obtain a new performance threshold value.

26. The speech coder of claim 25, wherein the quantization module is further configured to compare speech coder performance with a predefined performance measure and adjust the preselected encoding rate for the frame if the speech coder performance for the frame falls below the current performance threshold value.

27. The speech coder of claim 26, wherein the coding rate is adjusted by being increased.

28. The speech coder of claim 26, wherein the quantization module is further configured to:

subtract, during encoding of the frame, for each occurrence count of a speech coder performance threshold value that is less than the current performance threshold value, the product of the decrement-per-speech-coder-performance-threshold-occurrence-count-value and one plus the number of occurrence counts of speech coder performance threshold values between the occurrence count of a speech coder performance threshold value and the current performance threshold value from the current performance threshold value, and set the occurrence count of a speech coder performance threshold value equal to the result of the subtraction;

add, during encoding of the frame, for each occurrence count of a speech coder performance threshold value that is greater than the current performance threshold value, the product of the increment-per-speech-coder-performance-threshold-occurrence-count-value and one plus the number of occurrence count of speech coder performance threshold values between the occurrence count of a speech coder performance threshold value and the current performance threshold value to the current performance threshold value, and set the occurrence count of a speech coder performance threshold value equal to the result of the addition; and increment by one, during encoding of the frame, the occurrence count of a speech coder performance threshold value that corresponds to the current speech coder performance.

29. The speech coder of claim 25, wherein the quantization module is further configured to obtain the preselected encoding rate from an open-loop classification of the frame.

30. The speech coder of claim 25, wherein the quantization module is further configured to further constrain the current performance threshold to a maximum value.

31. The speech coder of claim 25, wherein the quantization module is further configured to constrain the current performance threshold to a minimum value.

32. The speech coder of claim 25, wherein the quantization module is further configured to assign initial values to the decrement-per-speech-coder-performance-threshold-occurrence-count-value and the increment-per-speech-coder-performance-threshold-occurrence-count-value.

33. The speech coder of claim 25, wherein the quantization module is further configured to for reset all occurrence counts of speech coder performance threshold values to zero after the current performance threshold value has been adjusted.

34. The speech coder of claim 25, wherein the frame is a speech frame.

35. The speech coder of claim 25, wherein the frame is a linear predictive residue frame.

36. The speech coder of claim 25, wherein the speech coder resides in a subscriber unit of a wireless communication system.

* * * * *